US010645760B2

(12) United States Patent
Torita

(10) Patent No.: US 10,645,760 B2
(45) Date of Patent: May 5, 2020

(54) HEATER DEVICE AND METHOD FOR PRODUCING THE SAME

(71) Applicant: Murata Manufacturing Co., Ltd., Nagaokakyo-shi, Kyoto-fu (JP)

(72) Inventor: Takeshi Torita, Philadelphia, PA (US)

(73) Assignee: MURATA MANUFACTURING CO., LTD., Nagaokakyo-Shi, Kyoto-Fu (JP)

( * ) Notice: Subject to any disclaimer, the term of this patent is extended or adjusted under 35 U.S.C. 154(b) by 166 days.

(21) Appl. No.: 15/596,224

(22) Filed: May 16, 2017

(65) Prior Publication Data

US 2018/0338352 A1 Nov. 22, 2018

(51) Int. Cl.

| | |
|---|---|
| ***H05B 3/84*** | (2006.01) |
| ***H01C 17/065*** | (2006.01) |
| ***H05B 3/14*** | (2006.01) |

(52) U.S. Cl.

CPC ..... *H05B 3/84* (2013.01); *H01C 17/0652* (2013.01); *H01C 17/06526* (2013.01); *H05B 3/14* (2013.01); *H05B 2203/011* (2013.01)

(58) Field of Classification Search

CPC . H05B 3/84; H05B 3/283; H05B 3/14; H05B 2203/011; C23C 22/66; C09D 5/084; C09D 1/00; H01C 17/06526; H01C 17/0652

USPC ..... 219/553

See application file for complete search history.

(56) References Cited

U.S. PATENT DOCUMENTS

| | | | | |
|---|---|---|---|---|
| 4,952,783 | A | 8/1990 | Aufderheide et al. | |
| 6,133,557 | A * | 10/2000 | Kawanabe | H01L 21/67103 219/544 |
| 2013/0048339 | A1 | 2/2013 | Tour | |
| 2014/0021195 | A1* | 1/2014 | Kim | H05B 3/84 219/553 |
| 2014/0162130 | A1* | 6/2014 | Barsoum | C01B 21/06 429/231.8 |
| 2015/0114952 | A1 | 4/2015 | Tai | |
| 2015/0210044 | A1* | 7/2015 | Barsoum | C01B 21/06 429/231.8 |
| 2017/0294546 | A1* | 10/2017 | Ghidiu | H01L 33/42 |

FOREIGN PATENT DOCUMENTS

| | | | |
|---|---|---|---|
| EP | 2884499 | A1 | 6/2015 |
| WO | WO 2016049109 | A2 | 3/2016 |

* cited by examiner

*Primary Examiner* — Umashankar Venkatesan
(74) *Attorney, Agent, or Firm* — Arent Fox LLP

(57) ABSTRACT

A heater device that includes a planar heating element that is electrically conductive and two electrodes electrically connected to the planar heating element. The planar heating element includes a layered material having a plurality of layers, each layer having a crystal lattice which is represented by: $M_{n+1}X_n$ (wherein M is at least one metal of Group 3, 4, 5, 6, or 7; X is a carbon atom, a nitrogen atom, or a combination thereof; and n is 1, 2, or 3), and in which each X is positioned within an octahedral array of M, and having at least one modifier or terminal T selected from the group consisting of a hydroxy group, a fluorine atom, an oxygen atom, and a hydrogen atom on at least one of two opposing surfaces of said each layer.

9 Claims, 3 Drawing Sheets

HEATER DEVICE AND METHOD FOR PRODUCING THE SAME

TECHNICAL FIELD

The present invention relates to a heater device, more specifically to a heater device having a planar heating element and a method for producing the same.

BACKGROUND ART

A heater device using an electrically conductive film as a planar heating element is known. Particularly, a heater device having a flexible, transparent, and electrically conductive film as a planar heating element is used as, for example, a defroster, a defogger or the like of a window or a display in an automotive vehicle, a building, a showcase, and various devices and/or facilities, and demand for the heater device is increasing as the applications thereof is being expanded.

A heater device applying as a planar heating element an electrically conductive material such as ITO (indium tin oxide) or PEDOT:PSS (poly(3,4-ethylenedioxythiophene) doped with polystyrene sulfonate) which is conventionally used for transparent electrodes is known (Patent Literatures 1 and 2). In addition, graphene which is one of two-dimensional materials is transparent in the form of a single layer or several layers, and therefore a transparent electrode and a heater device using graphene are also known (Patent Literatures 3 and 4).

CITATION LIST

Patent Literatures

Patent Literature 1: U.S. Pat. No. 4,952,783
Patent Literature 2: US 2015/0114952 A1
Patent Literature 3: US 2013/0048339 A1
Patent Literature 4: US 2014/0021195 A1
Patent Literature 5: EP 2884499 A1
Patent Literature 6: WO 2016/049109 A2

SUMMARY OF INVENTION

Technical Problem

However, an electrically conductive film using ITO has some problems such as a slow heat generating speed, unstable supply of indium, which is rare metal, fragility due to being a ceramic thin film (unbendable because crack occurs when being bent) (see paragraph 0007 of Patent Literature 2).

An electrically conductive film using PEDOT:PSS has a problem that supply of PEDOT:PSS is unstable (prices, market fluctuations, or the like). In addition, PEDOT:PSS alone has a high sheet resistance and a high thermal conductivity, and is thus not suitable for the use as a planar heating element, and thus it is needed that conductive filler (more specifically, carbon nanoparticles and graphene on which metal such as silver is deposited) is dispersed in a polymer matrix of PEDOT:PSS to improve the electrical and thermal conductivity thereof (Patent Literature 2). There is a problem that a composite electrically-conductive film of PEDOT:PSS-electrically-conductive filler needs a certain thickness (125 μm in examples of Patent Literature 2) to be used as a planar heating element and thus takes costs. Further, in order to develop electrical conductivity, PEDOT:PSS generally needs to be subjected to heat treatment (drying) after forming a film by adding ethylene glycol or the like, and thus there is also a problem that the material of a substrate is limited to materials that are durable against the heat treatment (in the examples of Patent Literature 2, a composite electrically-conductive film of PEDOT:PSS-electrically-conductive filler is formed on a polyethylene terephthalate substrate, and then the composite electrically-conductive film is subjected to heat treatment at 120° C. for 60 seconds). Further, it is generally known that physical properties of PEDOT:PSS may change when heated, and there is a disadvantage that PEDOT:PSS is not suitable for use in a heater device.

Since graphene alone has a high sheet resistance (surface resistance) and a low thermal conductivity, an electrically conductive film using graphene is not suitable for use as a planar heating element, and therefore, its electrical conductivity and thermal conductivity (maximum temperature) is improved by, for example, increasing the laminate number of graphene layers, forming a graphene layer on a metal layer or on an electrically conductive pattern, or doping graphene with $HNO_3$ or $AuCl_3$ (Patent Literature 4). However, this is not preferable because light transmittance decreases as the laminate number of graphene layers or the thickness of the metal layer increases. In addition, in the case where an electrically conductive pattern is used, since the electrically conductive pattern itself is not transparent, the light transmittance of the layer becomes non-uniform over the layer, and thus the application of the heater device is limited. In addition, a graphene layer is formed on the substrate via a method in which a graphene layer formed in advance is transferred onto the substrate or a method in which graphene is grown on the substrate by using as a catalyst a metal layer previously formed on the substrate and supplying carbon material gas and heat (300 to 2000° C.) to the substrate, and thus there is also a problem that these methods are both complicated in terms of processes of production, and the material of the substrate is limited to materials that are durable against heat in the latter method. Further, since an electrical property of graphene sensitively is lowered in the case where a defect occurs in the arrangement of carbon atoms of graphene, a protective layer covering a graphene layer practically needs to be provided.

In recent years, MXene has caught much attention as a novel material that has a high electrical conductivity and a high thermal conductivity (Patent Literatures 5 and 6). MXene is one of so-called two-dimensional materials and is a layered material, as will be described, comprising a plurality of layers, each layer having a crystal lattice which is represented by $M_{n+1}X_n$ (wherein M is at least one metal of Group 3, 4, 5, 6, or 7 metal, X is a carbon atom and/or a nitrogen atom, and n is 1, 2, or 3), and in which each X is positioned within an octahedral array of M, and having a terminal (or modifier) T such as a hydroxy group, a fluorine atom, an oxygen atom, or a hydrogen atom on the surface of each layer. However, application of an electrically conductive film using MXene described above to a planar heating element of a heating device has not been tried or considered.

Generally, all conductive materials used as transparent electrodes are not necessarily applicable to planar heating elements. For example, in the case of metal wiring or nanowires used as transparent electrodes, a straight line portion and an intersection portion of the wiring have different electrical resistance values, and thus a part having a locally high electrical resistance is present. In this case, there is a risk that abnormal generation of heat occurs at the part and the wiring become broken, and thus these are not suitable to be used for a planar heating element. Thus, it is assumed that having uniform quality in electrical resistivity is the minimum requirement for a film usable as a planar heating element. Further examination needs to be carried out from various other perspectives. The resistance value of metal increases (changes over time) due to oxidation, and further, in the case of silver, contact with moisture causes migration and may degrade the performance of the device. Therefore, a protective layer needs to be provided to prevent air, moisture, and the like from getting into the film. In the case of metal wiring, a moiré pattern derived from the periodicity of the wiring (such as mesh and grids) may occur, and thus the use of the device is limited. In addition, in the case of metal nanowires, the film needs to be subjected to firing treatment (typically at a temperature of 200° C. or more) after formation of the film to achieve a lower electrical resistivity, and there is a problem that the material of the substrate is limited to materials that are durable against this firing treatment.

In these circumstances, the present inventors have reached the present invention as a result of diligent studies to provide a novel heater device having a planar heating element.

Solution to Problem

According to an aspect of the present invention, there is provided a heater device comprising:

(a) a planar heating element that is electrically conductive; and (b) two electrodes electrically connected to the planar heating element, wherein the planar heating element comprises a layered material comprising a plurality of layers, each layer having a crystal lattice which is represented by a formula below:

$$M_{n+1}X_n$$

(wherein M is at least one metal of Group 3, 4, 5, 6, or 7;

X is a carbon atom, a nitrogen atom, or a combination thereof; and n is 1, 2, or 3), and in which each X is positioned within an octahedral array of M, and having at least one modifier or terminal T selected from the group consisting of a hydroxy group, a fluorine atom, an oxygen atom, and a hydrogen atom on at least one of two opposing surfaces of said each layer.

In the heater device of the present invention, since the prescribed layered material (also referred to as "MXene" in this specification) is used for the planar heating element and MXene has a high electrical conductivity and a high thermal conductivity and is hydrophilic, a planar heating element (or an electrically conductive film) that is very thin, has a low electrical resistivity (more specifically sheet resistance), and is uniform in quality can be formed, preferably so as to being transparent and flexible, on an arbitrary substrate at low cost via a method that is remarkably simple and does not require heat treatment as will be described later, and, as a result of this, a novel heater device having a planar heating element including MXene can be obtained.

In an embodiment of the present invention, the planar heating element may have a thickness of not less than 10 nm and not more than 200 nm, and particularly not less than 10 nm and not more than 40 nm.

In an embodiment of the present invention, the planar heating element may have a light transmittance of 70% or higher at a wavelength of 550 nm. In addition, in an embodiment of the present invention, the heater device may further comprise a substrate for supporting the planar heating element, and a laminate of the planar heating element and the substrate may have a light transmittance of 70% or higher at a wavelength of 550 nm.

According to another aspect of the present invention, there is provided a method of producing a heater device, which comprises:

(i) preparing a dispersion in which a layered material comprising a plurality of layers is dispersed in a liquid medium (or a fluid medium, the same applies hereafter), each layer having a crystal lattice which is represented by a formula below:

$$M_{n+1}X_n$$

(wherein M is at least one metal of Group 3, 4, 5, 6, or 7;

X is a carbon atom, a nitrogen atom, or a combination thereof; and n is 1, 2, or 3), and in which each X is positioned within an octahedral array of M, and having at least one modifier or terminal T selected from the group consisting of a hydroxy group, a fluorine atom, an oxygen atom, and a hydrogen atom on at least one of two opposing surfaces of said each layer;

(ii) forming an electrically conductive film derived from the dispersion by applying the dispersion on a surface of a substrate, and thus obtaining the electrically conductive film as a planar heating element; and (iii) electrically connecting two electrodes to the planar heating element.

In an embodiment of the present invention, the liquid medium may comprise at least one selected from the group consisting of aqueous solvents and hydrophilic organic solvents.

In an embodiment of the present invention, the formation of the electrically conductive film in the step (ii) may be conducted by at least partially removing the liquid medium from the dispersion at a temperature of not less than 10° C. and not more than 40° C.

In an embodiment of the present invention, the substrate may comprise at least one material selected from the group consisting of glass, and polyethylene terephthalate, polyvinyl alcohol, polypropylene, polystyrene, polycarbonate, polyethylene, polyamide, and resins based on any one of them.

Advantageous Effects of Invention

According to the present invention, since MXene is used for the planar heating element, has a high electrical conductivity and a high thermal conductivity, and is hydrophilic, a planar heating element (or an electrically conductive film) that is very thin, has a low electrical resistivity (more specifically sheet resistance), and is uniform in quality can be formed, preferably so as to being transparent and flexible, on an arbitrary substrate at low cost via a method that is remarkably simple and does not require heat treatment, and, as a result of this, a novel heater device having a planar heating element including MXene can be obtained. In addition, according to the present invention, a method for producing the heater device can be also provided.

DESCRIPTION OF EMBODIMENTS

Although a heater device having a planar heating element according to the present invention and a method of producing the same will be described in detail through some embodiments, the present invention is not limited to these embodiments.

Embodiment 1

Figure 1:
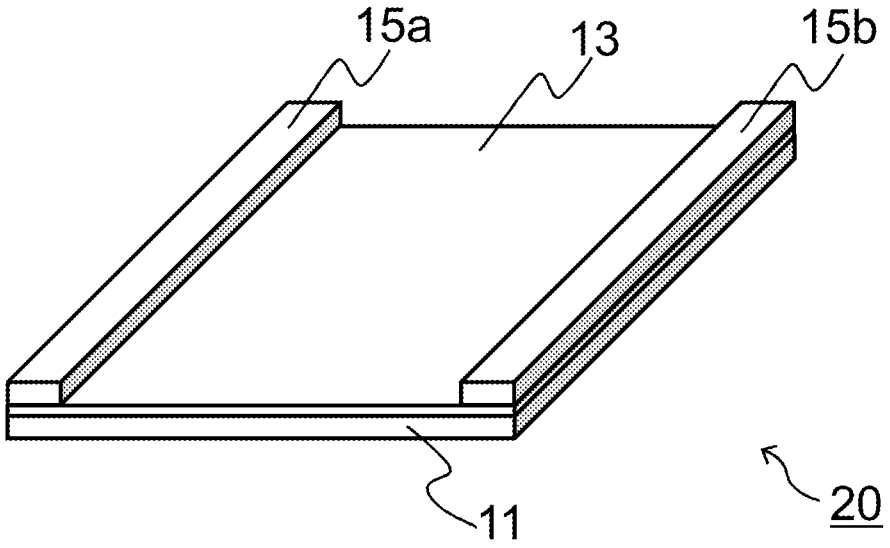
FIG. 1 is a schematic perspective view of a heater device having a planar heating element according to an embodiment of the present invention.

With reference to FIG. 1, a heater device 20 including a planar heating element according to the present embodiment includes:

(a) a planar heating element (or an electrically conductive film) 13 that is electrically conductive; and (b) two electrodes 15*a* and 15*b* electrically connected to the planar heating element 13, and wherein the planar heating element 13 contains a prescribed layered material including a plurality of layers.

A material usable as the prescribed layered material in the present embodiment is MXene, which is defined as follows:

A layered material including a plurality of layers, and each layer having a crystal lattice which is represented by the following formula:

$$M_{n+1}X_n$$

(wherein M is at least one metal of Group 3, 4, 5, 6, or 7 and may include at least one metal selected from the group consisting of so-called early transition metals, for example, Sc, Ti, Zr, Hf, V, Nb, Ta, Cr, Mo, and Mn;

X is a carbon atom, a nitrogen atom, or a combination thereof; and n is 1, 2, or 3), and in which each X is positioned in a octahedral array of M, and having at least one modifier or terminal T selected from the group consisting of a hydroxy group, a fluorine atom, an oxygen atom, and a hydrogen atom, preferably a hydroxy group, on at least one of two opposing surfaces of said each layer.

Such MXene can be obtained by selectively etching A atoms from an MAX phase. The MAX phase has a crystal lattice which is represented by the following formula:

$$M_{n+1}AX_n$$

(wherein M, X, and n are the same as described above; and A is at least one element of Group 12, 13, 14, 15, or 16, normally an element of A Group, typically of IIIA Group or IVA Group, more specifically at least one element selected from the group consisting of Al, Ga, In, Tl, Si, Ge, Sn, Pb, P, As, S, and Cd, and is preferably Al), and in which each X is positioned in an octahedral array of M, and has a crystal structure in which a layer constituted by A atoms is positioned between layers represented by $M_{n+1}X_n$. The MAX phase schematically includes a repeating unit in which each one of layers of X atoms is disposed between adjacent layers of n+1 layers of M atoms (these are also collectively referred to as a "$M_{n+1}X_n$ layer"), and a layer of A atoms ("A atom layer") is disposed as a layer next to the (n+1)th layer of M atoms. The A atom layer is removed by selectively etching A atoms from the MAX phase. This causes delamination of the $M_{n+1}X_n$ layer, the exposed surface of the $M_{n+1}X_n$ layer is modified by hydroxy groups, fluorine atoms, oxygen atoms, hydrogen atoms, or the like present in an etching liquid (an aqueous solution of fluorine-containing acid is typically used, but not limited to this), and thus the surface is terminated.

For example, the MAX phase is $Ti_3AlC_2$, and MXene is $Ti_3C_2T_s$.

In the present invention, MXene may contain remaining A atoms at a relatively small amount, for example, equal to or less than 10% by mass with respect to the original content of A atoms.

Figure 3:
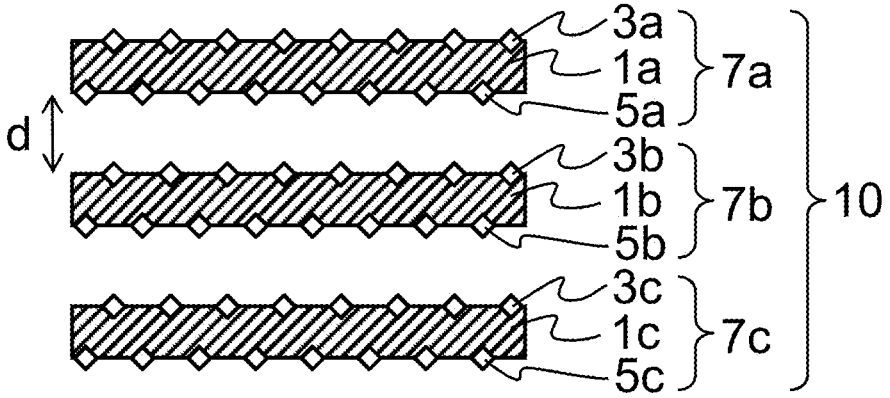
FIG. 3 is a schematic sectional view of MXene that is a layered material usable for a planar heating element according to an embodiment of the present invention.

As schematically illustrated in FIG. 3, MXene 10 obtained in this way may be a layered material including two or more (although three layers are illustrated in the figure as an example, this is not limiting) MXene layers (these are also represented by "$M_{n+1}X_n$ $T_s$", and s is an arbitrary number) 7*a*, 7*b*, and 7*c* obtained by modifying or terminating the surfaces of $M_{n+1}X_n$ layers 1*a*, 1*b*, and 1*c* with modifiers or terminals T 3*a*, 5*a*, 3*b*, 5*b*, 3*c*, and 5*c*. The MXene 10 may be a plurality of MXene layers which are separated and individually present (single-layer structure), a laminate in which a plurality of MXene layers are laminated with gaps interposed therebetween (multi-layer structure), or a mixture thereof. MXene may be an aggregation (may be also referred to as particles, powder, or flakes) of individual MXene layers (single layers) and/or laminates of MXene layers. In the case of the laminate, two adjacent MXene layers (for example, 7*a* and 7*b*, and 7*b* and 7*c*) do not need to be completely separated, and may be partially in contact with each other. It is preferable to use MXene layers separated into individual layers (single layers) to obtain an electrically conductive film having a high light transmittance, but the present invention is not limited to this.

Although the following description is not given to limit the present embodiment, each layer of MXene (corresponding to MXene layers 7*a*, 7*b*, and 7*c* described above) has a thickness of, for example, not less than 0.8 nm and not more than 5 nm, and particularly not less than 0.8 nm and not more than 3 nm (the thickness may vary depending mainly on the number of M atom layers included in each layer), and the maximum dimension of MXene in a plane parallel to the layer (two-dimensional sheet plane) is, for example, not less than 0.1 μm and not more than 200 μm, particularly not less than 0.5 μm and not more than 100 μm, and yet particularly not less than 1 μm and not more than 40 μm. In the case where MXene is a laminate, as to each individual laminate, the inter-layer distance (or a gap dimension indicated by d in FIG. 3) is, for example, not less than 0.8 nm and not more than 10 nm and particularly not less than 0.8 nm and not more than 5 nm, and yet particularly about 1 nm, and the total number of layers may be 2 or more, and, for example, is not less than 50 and not more than 100,000 and particularly not less than 1,000 and not more than 20,000, the thickness in the lamination direction is, for example, not less than 0.1 μm and not more than 200 μm and particularly not less than 1 μm and not more than 40 μm, and the maximum dimension in a plane (two-dimensional sheet plane) perpendicular to the lamination direction is, for example, not less than 0.1 μm and not more than 100 μm and particularly not less than 1 μm and not more than 20 μm. To be noted, these dimensions are obtained as number average dimensions (for example, number average of at least 40 samples) based on a scanning electron microscope (SEM) image or a transmission electron microscope (TEM) image.

MXene has a remarkably high carrier density (carrier concentration) and a high electrical conductivity in an in-plane direction, and also has a high electrical conductivity (for example, compared with graphene) in the thickness direction because MXene contains metal atoms M. With a high electrical conductivity in the thickness direction, conduction between MXene (single layers and/or laminates) is more likely to be achieved, and thus a low sheet resistance can be achieved. Further, since MXene contains metal atoms M, MXene also has a high thermal conductivity (for example, compared with graphene).

In addition, MXene includes surface modifiers or terminals T that may be polar or ionic, and thus the surface thereof is highly hydrophilic. The contact angle of water on the surface of MXene may be, for example, 45° or less, and typically not less than 20° and not more than 35°. In MXene, the modifiers or terminals T may be present periodically or regularly in accordance with the crystal structure of $M_{n+1}X_n$ (it is to be noted that no polar or ionic modifiers, terminals, or the like that are regularly arranged are present on graphene).

Any material may be used for the planar heating element 13 as long as the planar heating element 13 includes the MXene 10 that is a layered material. The content of MXene in the planar heating element 13 may be, for example, not less than about 50% by mass and not more than 100% by mass.

In addition, the planar heating element 13 may further contain other components. For example, the planar heating element 13 may further contain carbon nanotube. Carbon nanotube is a material formed in a tube shape from a single layer or multiple layers of graphene sheets, and has a diameter (outer diameter) in the order of nanometers or less. By adding carbon nanotube, the electrical conductivity of the planar heating element 13 can be improved. The carbon nanotube may be carried on the surface of plural layers of MXene and/or in the interface of two adjacent layers of MXene. Although the dimension of the carbon nanotube may be selected as appropriate, the average diameter thereof may be, for example, not less than 0.5 nm and not more than 200 nm and particularly not less than 1 nm and not more than 50 nm, and the average length thereof may be, for example, not less than 0.5 μm and not more than 200 μm and particularly not less than 1 μm and not more than 50 μm. To be noted, these dimensions are obtained as number average dimensions (for example, number average of at least 40 samples) based on a scanning electron microscope (SEM) image or a transmission electron microscope (TEM) image.

The ratio of carried carbon nanotube is not particularly limited, but may be, for example, not less than 1 part by mass and not more than 50 parts by mass and particularly not less than 1 part by mass and not more than 10 parts by mass with respect to 100 parts by mass of MXene.

In addition, for example, the planar heating element 13 may contain an arbitrary appropriate additive such as an ultraviolet light absorbent or a colorant.

The planar heating element 13 may be understood as an electrically conductive film containing the MXene 10. However, the planar heating element 13 does not necessarily have a solid film shape, and gaps between layers and/or laminates of the MXene 10 may be spaces.

In the heater device 20, the two electrodes 15*a* and 15*b* are electrically connected to the planar heating element 13. The electrodes 15*a* and 15*b* may be disposed in any manner as long as a current can flow in the planar heating element 13 to generate heat. Although the electrodes 15*a* and 15*b* may be representatively disposed at opposing end portions of the planar heating element 13, the arrangement is not limited to this. The number of electrodes electrically connected to the planar heating element 13 may be 3 or more. The material constituting the electrodes may be selected as appropriate, and may be, for example, metal such as copper, silver, gold, or aluminum, an electrically conductive adhesive, or metal clips.

In addition, the heater device 20 of the present embodiment may further include a substrate 11 that supports the planar heating element 13 as illustrated in FIG. 1. The material of the substrate 11 is not particularly limited, and may be an arbitrary appropriate material, so that it can be selected from any material in consideration of a desired property according to the application of the heater device 20, for example, light transmittance, flexibility, elasticity, or a gas barrier property. The substrate 11 may contain at least one material selected from the group consisting of, for example, inorganic materials such as glass, and organic materials such as polyethylene terephthalate, polyvinyl alcohol, polypropylene, polystyrene, polycarbonate, polyethylene, polyamide (particularly may be aliphatic polyamide referred to as nylon, but is not limited to this), and resin based on any of these. To be noted, the phrase "resin based on . . . " used herein indicates polymer and/or polymeric materials that may contain other monomer units and may have arbitrary appropriate substituents and/or modifying groups.

In addition, the heater device 20 of the present embodiment may further include a protective layer (not illustrated) that protects at least the planar heating element 13 (and the electrodes 15*a* and 15*b* and so forth in some case). The protective layer can prevent possible deterioration of MXene over time. The material of the protective layer is not particularly limited as long as deterioration of MXene over time can be prevented, and may be an arbitrary appropriate material, and further, it can be selected in consideration of a desired property according to the application of the heater device 20, for example, light transmittance, flexibility, elasticity, or a gas barrier property. The protective layer may contain at least one material selected from the group consisting of, for example, inorganic materials such as glass, and organic materials such as polyethylene terephthalate, polyvinyl alcohol, polypropylene, polystyrene, polycarbonate, polyethylene, polyamide (particularly may be aliphatic polyamide referred to as nylon, but is not limited to this), and resin based on any of these.

The heater device 20 of the present embodiment can cast heat to the surrounding via conduction and/or radiation by applying a voltage between the electrodes 15*a* and 15*b* to cause a current to flow in the planar heating element 13 and thereby cause the planar heating element 13 to generate heat by Joule heating. According to the present embodiment, the MXene 10 having high electrical and thermal conductivity is used for the planar heating element 13, and thus the planar heating element 13 that has a high heat generation property, a low sheet resistance, a high light transmittance, and flexibility can be realized. To be noted, for example, the maximum temperature (or a temperature after reaching a substantially steady state) of a temperature measured as a surface temperature of the planar heating element 13 in the case where a prescribed voltage is applied between the electrodes 15*a* and 15*b* of the heater device 20 may be used as an indicator of the heat generation property.

The thickness of the planar heating element (electrically conductive film) 13 may be selected as appropriate in accordance with the material constituting the planar heating element and a desired heat generation property, sheet resistance, light transmittance, and the like, and may be, for example, not less than 1 nm and not more than 500 nm, particularly not less than 10 nm and not more than 200 nm, and preferably not less than 10 nm and not more than 40 nm. According to the present embodiment, a sufficiently low sheet resistance and a sufficiently high heat generation property can be achieved even for the planar heating element 13 that is remarkably thin as described above, and thus the planar heating element 13 can be produced at low cost. By setting the thickness of the planar heating element 13 to 1 nm or more, particularly 10 nm or more, a planar heating element having a low sheet resistance and suitable for heat generation can be obtained. Meanwhile, by setting the thickness of the planar heating element 13 to 500 nm or less, particularly 200 nm or less, and preferably 40 nm or less, a planar heating element having a high light transmittance (in other words, that is transparent) can be obtained. Further, by setting the thickness of the planar heating element 13 to not less than 10 nm and not more than 40 nm, a high heat generation property can be achieved.

The light transmittance of the planar heating element (electrically conductive film) 13 at a wavelength of 550 nm can be, for example, 70% or more and particularly 90% or more. This indicates that the planar heating element 13 transmits light and is preferably transparent. In the case where the heater device 20 also includes the substrate 11 that supports the planar heating element 13, the light transmittance of a laminate of the planar heating element 13 and the substrate 11 at the wavelength of 550 nm can be set to, for example, 70% or more and particularly 90% or more by appropriately selecting the material of the substrate 11. This indicates that the laminate of the planar heating element 13 and the substrate 11 transmits light and is preferably transparent.

The heater device 20 of the present embodiment includes the planar heating element 13 containing MXene having a high electrical conductivity and a high thermal conductivity. Since the MXene 10 has a hydrophilic surface as described above, the planar heating element 13 having an electrical resistivity (more specifically, sheet resistance) substantially uniform in the in-plane direction can be formed on an arbitrary substrate 11 via, for example, a method that is remarkably simple and does not require heat treatment as will be described later in Embodiment 2. Since the planar heating element 13 obtained in this way has a low sheet resistance and a high thermal conductivity, the thickness of the planar heating element 13 can be reduced significantly, and thus the planar heating element 13 can be produced at low cost and thereby the heater device 20 can be produced at low cost. In addition, since the planar heating element 13 can be transparent and flexible, the heater device 20 can be used for various applications of a wide range in which transparency and/or flexibility is required.

Figure 2:
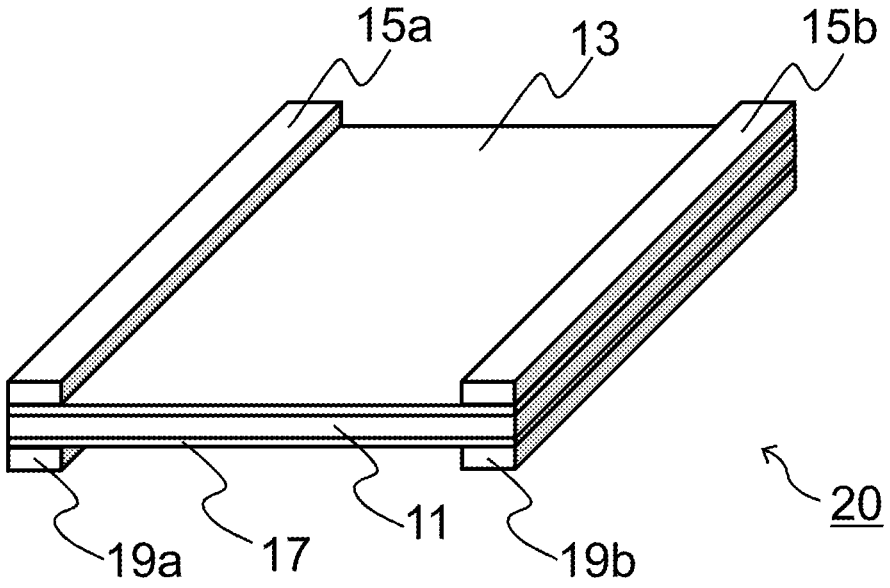
FIG. 2 is a schematic perspective view of a modified example of a heater device having a planar heating element according to an embodiment of the present invention.

The heater device 20 of the present embodiment is not limited to the embodiment illustrated in FIG. 1, and the substrate 11 is not necessarily present in the case where the planar heating element 13 can be configured as a free-standing film. Alternatively, in the heater device 20 of the present embodiment, planar heating elements 13 and 17 may be provided on respective surfaces of the substrate 11 as a modified embodiment illustrated in FIG. 2. In this case, the number and arrangement of electrodes are not particularly limited as long as a voltage can be applied to the planar heating elements 13 and 17. As illustrated in FIG. 2, the electrodes 15*a* and 15*b* may be electrically connected to the planar heating element 13, electrodes 19*a* and 19*b* may be electrically connected to the planar heating element 15, the electrodes 15*a* and 19*a* may be formed separately or integrally, and the electrodes 15*b* and 19*b* may be formed separately or integrally.

Embodiment 2

The present embodiment is related to a method for producing a heater device having the planar heating element according to Embodiment 1. Those that have been described in Embodiment 1 also apply to the present embodiment unless any particular description is given.

First, a dispersion in which at least MXene is dispersed in a liquid medium is prepared. MXene similar to that has been described in Embodiment 1 may be used. A dispersion in which MXene and carbon nanotube are dispersed in a liquid medium may be prepared. The dispersion may be in the form of slurry.

The liquid medium may be an aqueous solvent, a hydrophilic organic solvent, or a mixture of two or more of these, and may contain an additive or the like as appropriate. The aqueous solvent is representatively water, but is not limited to this, and may be an arbitrary appropriate water-based composition. Examples of the hydrophilic organic solvent include alcohols (representatively ethanol and methanol).

Since the liquid medium described above is aqueous or hydrophilic, the liquid medium has a good wettability on MXene having a hydrophilic surface, thus MXene can be easily dispersed in the liquid medium (even without any dispersing agent), and the liquid medium can be easily impregnated into interfaces of MXene layers.

Then, the dispersion containing MXene in the liquid medium obtained via the operation described above is applied on the surface of a substrate to form an electrically conductive film derived from the dispersion.

The substrate may be similar to that has been described in Embodiment 1. In the case where the surface of the substrate is hydrophilic, the dispersion may be directly applied on the surface of the substrate. In the case where the surface of the substrate is not hydrophilic or the hydrophilicity of the surface of the substrate is not sufficiently high, the surface is modified in advance by performing hydrophilization treatment on the surface, and the dispersion may be applied on the hydrophilized surface. The hydrophilization treatment may be performed via at least one method selected from, for example, the group consisting of plasma treatment, corona treatment, ultraviolet light irradiation, ultraviolet light-ozone treatment, and application of a hydrophilic coating agent. The hydrophilization treatments described above all have advantages of being simple and harmless to the substrate. The plasma treatment, corona treatment, ultraviolet light irradiation, and ultraviolet light-ozone treatment are dry processes, and have an advantage of not requiring to be performed in vacuum. The condition of these treatments may be appropriately selected in accordance with the surface of the substrate that is used. The application of the hydrophilic coating agent may be performed by just causing the coating agent to attach to a coating target surface of the substrate, and can be performed under normal pressure and not exposed in a relatively high temperature depending on the hydrophilic coating agent that is used. As the hydrophilic coating agent, an arbitrary appropriate hydrophilic coating agent may be used. For example, LAMBIC series (manufactured by Osaka Organic Chemical Industry Ltd.) may be used.

The contact angle of water on the surface of the substrate immediately before the dispersion is applied may be, for example, 45° or less and representatively not less than 20° and not more than 35°.

The method of forming an electrically conductive film derived from the dispersion by applying the dispersion on the surface of the substrate is not particularly limited, and this process may be performed by removing the liquid medium at least partially from the dispersion after and/or at the same time as applying the dispersion on the surface of the substrate. The removal of liquid medium may be conducted by drying (or making the liquid medium evaporate) at a temperature of not less than 10° C. and not more than 40° C., for example, at room temperature (in other words, in an environment that is not heated). Such method of film formation may be, for example, spin casting (spin coating and solvent casting), spraying, or dip coating, and is preferably dip coating. Dip coating is a method of forming a film on the surface of the substrate by immersing the substrate in a coating liquid (in the present embodiment, the dispersion) and pulling up the substrate in the vertical direction at a prescribed slow speed (and then drying). The slower the pulling-up speed is, a thinner film is formed. These methods are all remarkably simple and do not require heat treatment.

According to the present embodiment, since MXene having a hydrophilic surface and an aqueous or hydrophilic liquid medium are used in combination as described above, a dispersion containing MXene and the liquid medium sufficiently wets and spreads on the surface (preferably a hydrophilic surface) of the substrate, and thus an electrically conductive film having a uniform thickness can be formed. The electrically conductive film that is obtained is uniform in quality, and particularly the electrical resistivity (more specifically, sheet resistance) thereof may be substantially uniform in the in-plane direction.

The electrically conductive film can be formed on the surface of an arbitrary substrate. The surface of the substrate may be flat, curved, or in any other complicated shape, and further an electrically conductive film having a large area can be easily formed thereon. The electrically conductive film may be formed on at least a part of the surface of the substrate, and may be formed on the whole area of the surface of the substrate. In addition, the electrically conductive film may be formed on either one of the surfaces of the substrate (see FIG. 1) or on both surfaces of the substrate (see FIG. 2). In the case where the electrically conductive film can be configured as a free-standing film, the substrate is removed from the electrically conductive film at an arbitrary appropriate timing after forming the electrically conductive film thereon.

The electrically conductive film obtained in this way functions as a planar heating element. At least two electrodes are electrically connected to the planar heating element. The connection between the planar heating element and the electrodes can be made via an arbitrary appropriate method, for example, by ensuring conduction with a solder paste, an electrically conductive adhesive, or metal clips. Alternatively, the electrodes may be electrically connected to the planar heating element by forming the electrodes so as to be directly in contact with the surface of the planar heating element via, for example, a method such as vacuum deposition, chemical vapor deposition, sputtering, printing, or plating.

In the way described above, a heater device having such a planar heating element as illustrated in FIG. 1 or 2 is produced. According to the present embodiment, an electrically conductive film that functions as the planar heating element can be formed at normal temperature, and thus the material of the substrate 11 is not particularly limited and may be formed from an arbitrary appropriate material. This material can be selected from a wide range of materials, and, for example, the materials described in Embodiment 1 may be used. In particular, even materials weak against heat, for example, polyethylene, polyethylene terephthalate, polyvinyl alcohol, polyamide (particularly aliphatic polyamide referred to as nylon), and resins based on any of these, can be used.

However, the heater device described in Embodiment 1 is not limited to be produced by the production method described in Embodiment 2, and the heater device may be produced via any other appropriate method.

Examples

Films of MXene were formed on substrates in different conditions, and the thickness, light transmittance, and sheet resistance of each film were measured. In addition, heater devices using these films were produced, and the heat generation property of each device was assessed. The details are as follows.

First, as a dispersion liquid for forming planar heating elements (electrically conductive films), dispersion liquids in which powder of $Ti_3C_2T_s$ (black powder of MXene of single layer and/or several layers, of which thickness in the lamination direction (average value of thicknesses including a thickness in case of a single layer) was about 200 nm in number average dimension based on a TEM image, and of which aspect ratio was not less than about 50 and not more than 100), which is a kind of MXene, is dispersed in water were prepared. The densities of MXene in the dispersion liquids were set to 20 mg/mL and 5 mg/mL (Table 1). The obtained dispersion liquids were uniformly black, and MXene was uniformly dispersed therein. It was recognized that MXene is easily wettable against water.

As a substrate, a glass substrate (Fisherfinest (trademark) Premium Cover Glasses, manufactured by Thermo Fisher Scientific Inc., longitudinal length of 75 mm, lateral width of 25 mm, thickness of 1 mm) was prepared. The substrate was immersed in the dispersion liquids (MXene-water dispersion liquids) prepared as described above and was pulled up in the vertical direction by using a nano dip-coater (model MD-0408-55, manufactured by SDI Company Ltd.). The pulling-up speeds were set to 2 mm/sec and 0.2 mm/sec (Table 1). The pulling-up operation was performed in an air atmosphere and at room temperature (about 25° C.), and the substrate was left to stand at room temperature for 2 minutes for drying.

As a result of the operation described above, each film was formed on the surface of the immersed area of the substrate. In this film, the water used as the solvent for the dispersion liquid was almost completely removed, and it can be understood that the film is constituted by $Ti_3C_2T_s$ (100% by mass) that is MXene.

The light transmittance at a wavelength of 550 nm of each laminate constituted by the substrate and the films formed on both surfaces of the substrate was measured by using a tint meter (ENFORCER II-TM1000, manufactured by Laser Labs, Inc.), which is a measurement device for transmittance of visual light. In addition, the sheet resistance of the film on one surface of the substrate was measured via a fourterminal method by using a resistivity meter (Loresta-GX MCP-T700, manufactured by Mitsubishi Chemical Analytech, Co., Ltd.). In addition, just for reference, the thickness of the film on one surface of the substrate was calculated from the measured value of light transmittance at a wavelength of 550 nm on the basis of experimental data. The results are shown in Table 1. To be noted, it was confirmed, from TEM images in section, that the films were able to be formed in substantially uniform thicknesses in all of the examples.

TABLE 1

| | Density of dispersion (mg/mL) | Film forming speed (mm/sec) | Light transmittance (%) | Sheet resistance (Ω/□) | Thickness (nm) |
|---|---|---|---|---|---|
| Example 1 | 20 | 2 | 20% | 42 | 200 |
| Example 2 | 20 | 0.2 | 57% | 143 | 80 |
| Example 3 | 5 | 2 | 73% | 433 | 40 |

Figure 4:
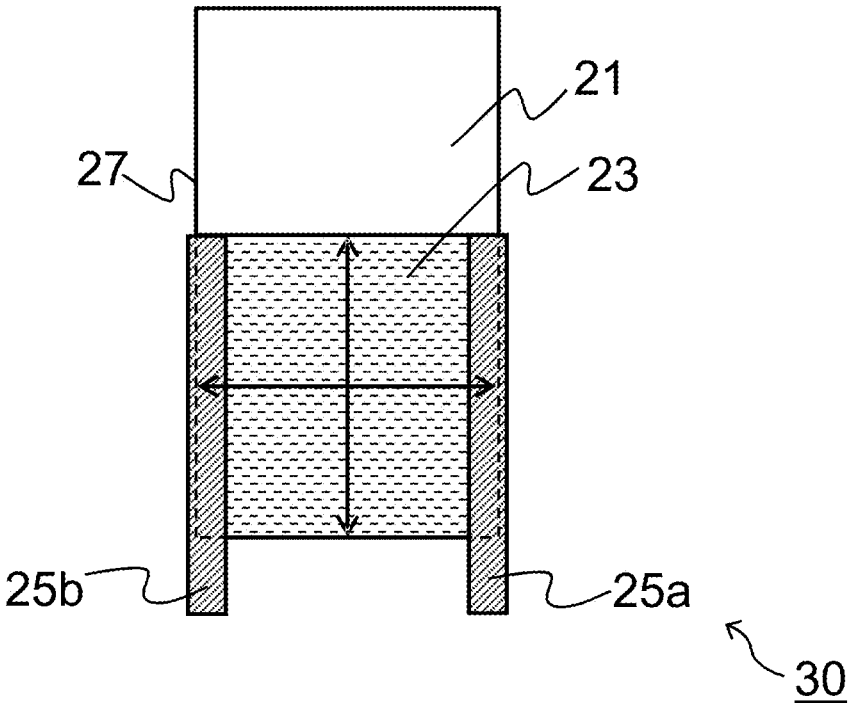
FIG. 4 is a schematic front view of a heater device produced in examples of the present invention.
Figure 5:
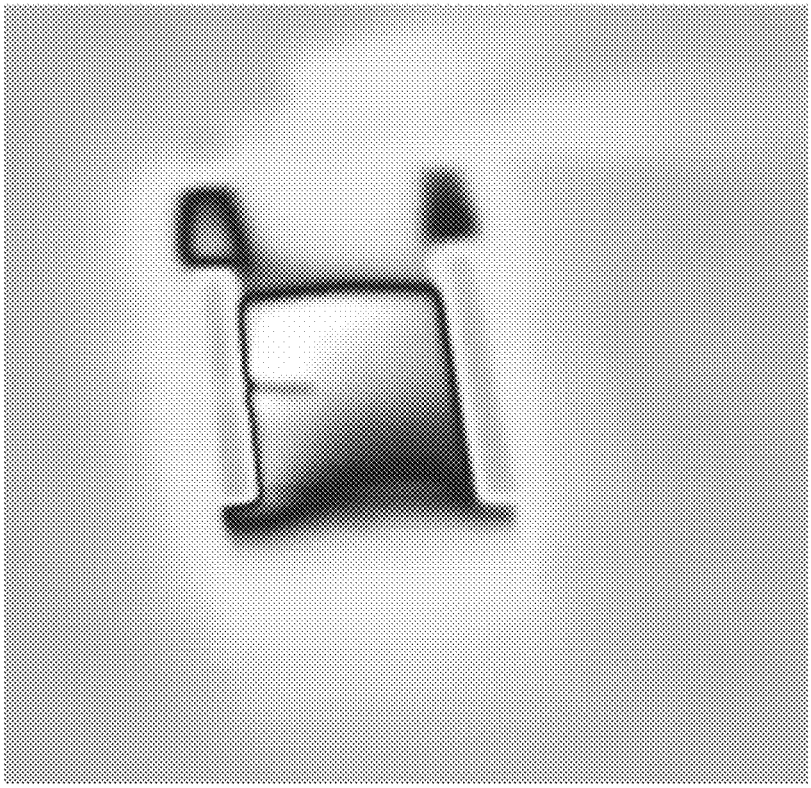
FIG. 5 is a thermographic image of a heater device produced in an example of the present invention.

Heater devices were produced by using the films formed as described above. FIG. 4 illustrates a schematic front view of a produced heater device. Specifically, a heater device 30 was produced by forming, by using a tape (electrically conductive copper foil adhesive tape No. 8323, manufactured by Teraoka Seisakusho Co., Ltd.) wherein an electrically conductive adhesive layer provided on one surface of a copper foil, extraction electrodes 25*a* and 25*b* on both end portions of a laminate including a substrate 21 and films 23 and 27 (in the figure, the film 27 is disposed on a back surface of the substrate 21 and is thus not illustrated) formed on both surfaces of the substrate 21 in a length of 25 mm and a width of 25 mm (indicated by double-headed arrows in the figure). The electrode 25*a* was formed on one end portion of the laminate so as to cover the film 23, an end section of the substrate 21 and the film 27, and the electrode 25*b* was formed on the other end portion of the laminate so as to cover the film 23, an end section of the substrate 21 and the film 27. Voltage was applied between the electrodes 25*a* and 25*b* of the heater device 30 produced in this way while changing the voltage stepwise from 3 V to 18 V with an increment of 3 V, the surface temperature of the heater device 30 was measured by infrared light thermography, and the maximum temperature of a temperature measured as the surface temperature of the film (near center) was measured (the maximum temperature corresponds to an achieving temperature as it is recognized as substantially reaching a steady state). As a representative example, FIG. 5 illustrates a thermographic image of a heater device produced by using a film according to Example 2, during operation (while voltage is applied). The results are shown in Table 2.

TABLE 2

| | Maximum temperature during application of voltage (° C.) | | | | | |
|---|---|---|---|---|---|---|
| Applied voltage | 3 V | 6 V | 9 V | 12 V | 15 V | 18 V |
| Example 1 | 27 | 31.2 | 33.7 | 39.6 | 43.2 | 39.2 |
| Example 2 | 28.3 | 41.5 | 63.3 | 86 | 95 | 135 |
| Example 3 | 26.5 | 29.5 | 35.8 | 43.2 | 51.2 | 60.3 |

From Table 2, it was confirmed that the films of Examples 1 to 3 formed through a room-temperature process could function as planar heating elements of heater devices even though the films were transparent and remarkably thin. While voltage is applied, all parts of the films formed in Examples 1 to 3 generated heat (no non-heat-generating part was present), and thus an appropriate operation as a heater was achieved. It can be understood that this indicates that the films were uniform in quality and the materials used for the films had sufficiently high thermal stability.

INDUSTRIAL APPLICABILITY

A heater device according to the present invention can be formed on any suitable substrate and can be transparent and flexible, and thus can be used for applications of a wide range, for example, as a defroster, a defogger or the like of a window or a display in an automotive vehicle, a building, a showcase, or various devices and/or facilities.

REFERENCE SIGNS LIST

1*a*, 1*b*, 1*c* $M_{n+1}X_n$ layer
3*a*, 5*a*, 3*b*, 5*b*, 3*c*, 5*c* modifier or terminal T
7*a*, 7*b*, 7*c* MXene layer
10 MXene (layered material)
11, 21 substrate
13, 17, 23, 27 planar heating element (electrically conductive film)
15*a*, 15*b*, 19*a*, 19*b*, 25*a*, 25*b* electrode
20, 30 heater device

The invention claimed is:

1. A heater device comprising: (a) a planar heating element that is electrically conductive; and (b) two electrodes electrically connected to the planar heating element, wherein the planar heating element comprises a layered material in the form of powder or flakes comprising a plurality of layers, a maximum longitudinal dimension of the powder or flakes in a plane parallel to the layered material is not more than 40 μm, each layer having a crystal lattice which is represented by:

$$M_{n+1}X_n$$

wherein M is at least one metal of Group 3, 4, 5, 6, or 7;
X is a carbon atom, a nitrogen atom, or a combination thereof; and
n is 1, 2, or 3, and in which each X is positioned within an octahedral array M, and having at least one modifier or terminal T selected from the group consisting of a hydroxy group, a fluorine atom, an oxygen atom, and a hydrogen atom on at least one of two opposing surfaces of said each layer.

2. The heater device according to claim 1, wherein the planar heating element has a thickness of not less than 10 nm and not more than 200 nm.

3. The heater device according to claim 2, wherein the planar heating element has a thickness of not less than 10 nm and not more than 40 nm.

4. The heater device according to claim 1, wherein the planar heating element has a light transmittance of 70% or more at a wavelength of 550 nm.

5. The heater device according to claim 1, further comprising a substrate for supporting the planar heating element, wherein a laminate of the planar heating element and the substrate has a light transmittance of 70% or more at a wavelength of 550 nm.

6. A method for producing a heater device, the method comprising: (i) preparing a dispersion in which a layered material in the form of powder or flakes comprising a plurality of layers is dispersed in a liquid medium, a maximum longitudinal dimension of the powder or flakes in a plane parallel to the layered material is not more than 40 μm, each layer having a crystal lattice which is represented by:

$$M_{n+1}X_n$$

wherein M is at least one metal of Group 3, 4, 5, 6, or 7;

X is a carbon atom, a nitrogen atom, or a combination thereof; and n is 1, 2, or 3, and in which each X is positioned within an octahedral array M, and having at least one modifier or terminal T selected from the group consisting of a hydroxy group, a fluorine atom, an oxygen atom, and a hydrogen atom on at least one of two opposing surfaces of said each layer;

(ii) forming an electrically conductive film derived from the dispersion by applying the dispersion on a surface of a substrate, and thus obtaining the electrically conductive film as a planar heating element; and (iii) electrically connecting two electrodes to the planar heating element.

7. The method for producing a heater device according to claim 6, wherein the liquid medium comprises at least one selected from the group consisting of aqueous solvents and hydrophilic organic solvents.

8. The method for producing a heater device according to claim 6, wherein the formation of the electrically conductive film in the step (ii) is conducted by at least partially removing the liquid medium from the dispersion at a temperature of not less than 10° C. and not more than 40° C.

9. The method for producing a heater device according to claim 6, wherein the substrate comprises at least one material selected from the group consisting of glass, and polyethylene terephthalate, polyvinyl alcohol, polypropylene, polystyrene, polycarbonate, polyethylene, polyamide, and resins based thereon.

* * * * *